US010125575B2

(12) United States Patent
Manera et al.

(10) Patent No.: US 10,125,575 B2
(45) Date of Patent: Nov. 13, 2018

(54) ALIGNMENT APPARATUS FOR A SLIDING SLEEVE SUBTERRANEAN TOOL

(71) Applicant: BAKER HUGHES, A GE COMPANY, LLC, Houston, TX (US)

(72) Inventors: Michael S. Manera, Tomball, TX (US); Marc N. Samuelson, Houston, TX (US); David Teale, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 640 days.

(21) Appl. No.: 14/549,281

(22) Filed: Nov. 20, 2014

(65) Prior Publication Data

US 2016/0145971 A1 May 26, 2016

(51) Int. Cl.

| | |
|---|---|
| ***E21B 23/00*** | (2006.01) |
| ***E21B 34/14*** | (2006.01) |
| ***E21B 34/12*** | (2006.01) |
| *E21B 34/00* | (2006.01) |

(52) U.S. Cl.

CPC ..... *E21B 34/14* (2013.01); *E21B 23/00* (2013.01); *E21B 23/004* (2013.01); *E21B 23/006* (2013.01); *E21B 34/12* (2013.01); *E21B 2034/007* (2013.01)

(58) Field of Classification Search

CPC ..... E21B 23/00; E21B 23/004; E21B 23/006; E21B 34/102; E21B 34/12; E21B 34/14; E21B 2034/007

See application file for complete search history.

(56) References Cited

U.S. PATENT DOCUMENTS

| | | | | |
|---|---|---|---|---|
| 5,309,993 | A * | 5/1994 | Coon | E21B 33/1208 166/115 |
| 6,860,330 | B2 * | 3/2005 | Jackson | E21B 34/14 166/320 |
| 7,367,393 | B2 | 5/2008 | Vachon | |
| 2006/0243455 | A1 * | 11/2006 | Telfer | E21B 21/103 166/386 |
| 2015/0021026 | A1 * | 1/2015 | Giroux | E21B 33/146 166/289 |

* cited by examiner

*Primary Examiner* — Giovanna C. Wright
*Assistant Examiner* — Tara E Schimpf
(74) *Attorney, Agent, or Firm* — Shawn Hunter

(57) ABSTRACT

An alignment device for a sliding sleeve in a housing in a tubular string features a patterned alignment ring that remains stationary. The sliding sleeve in one of its end positions has a mating profile such that profile misalignment results in profile alignment as the sliding sleeve is axially advanced toward the alignment ring. In a choke application the fully closed position of the choke brings the profiles together to induce relative rotation into an aligned configuration of the ports on the sliding sleeve with the ports on the surrounding housing. Misalignment can occur when tools are run through the sliding sleeve for other downhole operations and the design parameters for the choke prevent the use of alignment lugs in axial slots. The mating profiles do not reduce the drift dimension through the sliding sleeve and allow higher housing pressure ratings for deep set applications with large operating differential pressures.

19 Claims, 2 Drawing Sheets

ALIGNMENT APPARATUS FOR A SLIDING SLEEVE SUBTERRANEAN TOOL

FIELD OF THE INVENTION

The field of the invention is subterranean tools that have a movable member that needs to maintain a rotational orientation and a device to realign the member using engagement with an indexing device.

BACKGROUND OF THE INVENTION

In choke valves the sliding sleeve has a port and is axially moved for more or less alignment with a surrounding housing port to control the pressure drop across the choke valve. Typically a hydraulic fluid metering device or a j-slot assembly is used to move the sliding sleeve axially in the surrounding housing to control the opening size. In some designs in the past the sliding sleeve and the housing are rotationally locked with a lug in an axial recess arrangement. However, when made in certain small sizes there may not be enough room to use such a rotational locking arrangement. Other alignment systems use an open slot in a j-slot that steps the sliding sleeve axially for opening and closing the valve. That design is illustrated in U.S. Pat. No. 7,367,393 in the form of alignment lug 64 aligning housing components for a choke valve. Alignment is important because the openings in the sliding sleeve and the housing need to be in the same plane as the sliding sleeve is axially moved to control the pressure drop across the choke when it is partially or fully open. There are times when the choke is between the full closed and full open positions and other procedures are conducted through the valve that can result in relative rotation between the sliding sleeve and the housing in the absence of a rotational lock.

Accordingly, the present invention addresses a situation where the configuration of the choke such as the requirements for a pressure rating on the housing or a drift dimension through the sliding sleeve dictate against the provision of the known solution of rotationally locking the sliding sleeve to the surrounding housing. Instead of the traditional rotational alignment solutions that are not practically available in some situations, the present invention provides an alignment ring having a repeating pattern profile to match a similar profile at an end of the sliding sleeve. Accordingly, regardless of the initial orientation of the matching patterns, advancing the patterns toward each other will always produce an axial alignment of the circumferentially spaced ports on the sleeve with circumferentially spaced openings in the surrounding housing for normal operations. The sliding sleeve is preferably directed to the closed choke position which is the position where the profiles engage. If there is initial misalignment then bringing the patterns together realigns the sliding sleeve and housing ports for subsequent normal operation. This is done without reduction of the sliding sleeve drift dimension. These and other aspect of the present invention will be more readily apparent from a review of the description of the preferred embodiment and the associated drawings while recognizing that the full scope of the invention is to be found in the appended claims.

SUMMARY OF THE INVENTION

An alignment device for a sliding sleeve in a housing in a tubular string features a patterned alignment ring that remains stationary. The sliding sleeve in one of its end positions has a mating profile such that profile misalignment results in profile alignment as the sliding sleeve is axially advanced toward the alignment ring. In a choke application the fully closed position of the choke brings the profiles together to induce relative rotation into an aligned configuration of the ports on the sliding sleeve with the ports on the surrounding housing. Misalignment can occur when tools are run through the sliding sleeve for other downhole operations and the design parameters for the choke prevent the use of alignment lugs in axial slots. The mating profiles do not reduce the drift dimension through the sliding sleeve and allow higher housing pressure ratings for deep set applications with large operating differential pressures.

DETAILED DESCRIPTION OF THE PREFERRED EMBODIMENT

Figure 1:
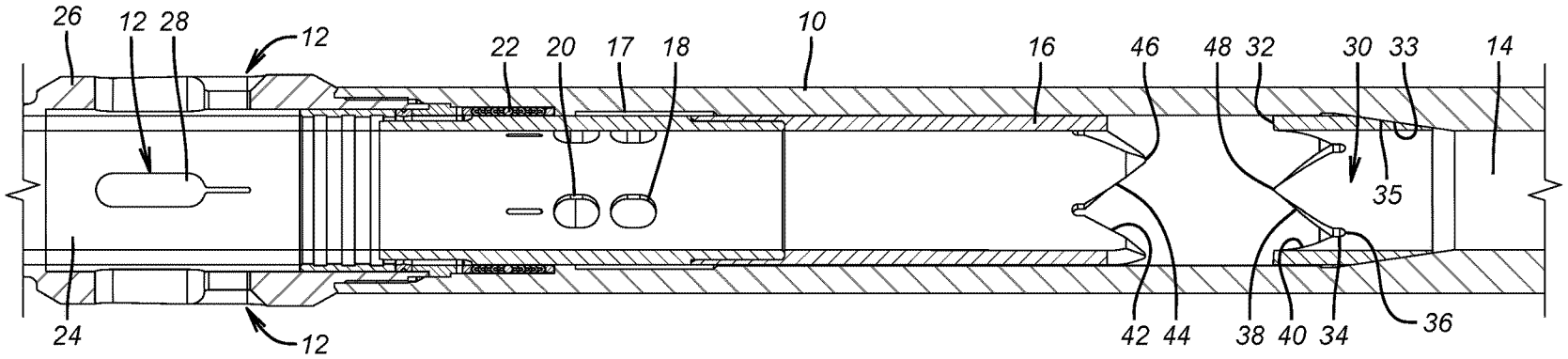
FIG. 1 shows a circumferential opening misalignment between a sliding sleeve and surrounding housing of a choke valve in the closed position shown in section.
Figure 3:
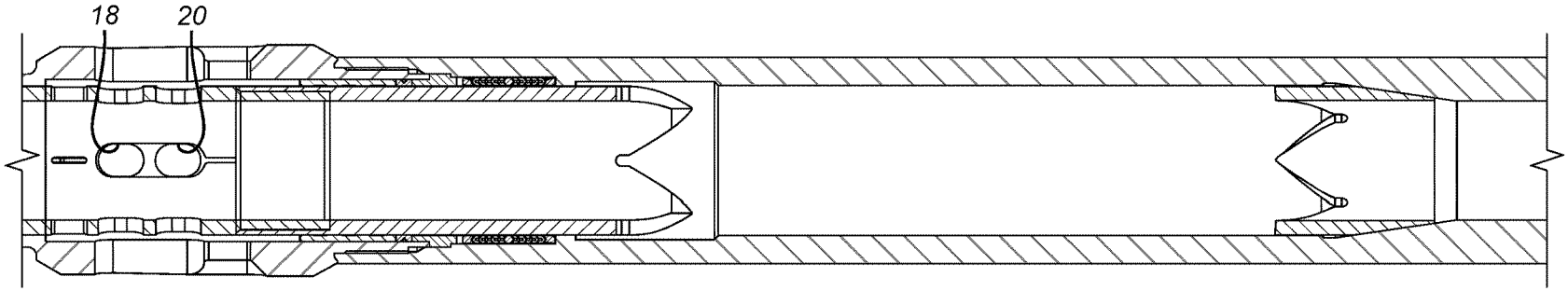
FIG. 3 is the view of FIG. 2 showing a subsequent resumption of normal operation with the choke in the wide open position.

FIG. 1 shows a choke valve housing 10 having multiple radial outlet ports referred to as openings 12 preferably circumferentially equally spaced while being in axial alignment as shown. Inlet passage 14 leads from a producing zone that is not shown and through a sliding sleeve 16 that has circumferentially spaced openings 18, 20 that are axially aligned in rows of two as shown in FIG. 1. A single opening of even or uneven size is an alternative. Mainly the opening or openings 18, 20 fall into full alignment with the openings 12 in the fully open position shown in FIG. 3.

In the FIG. 1 position the choke valve is closed because openings 18 and 20 are on an opposite side of seal assembly 22 which can optionally be chevron seal stacks from openings 12. There is a liner sleeve 24 in the top sub 26 that has openings 12. The shape of the openings 28 in sleeve 24 are the shape of the openings 12 in top sub 26. Alternatively the openings 12 themselves could have hardened sleeves as opposed to an internal sleeve 24 that is hardened or carbide.

Figure 2:
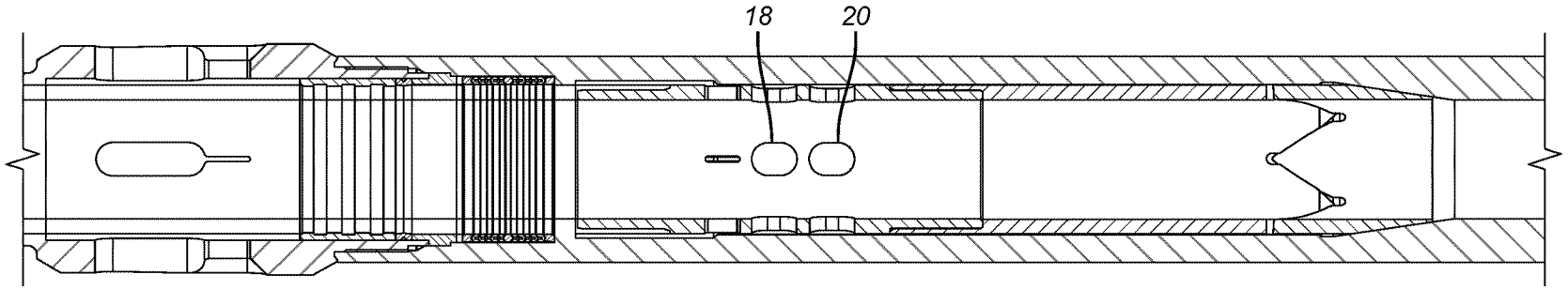
FIG. 2 is the view of FIG. 1 with the choke valve in the closed position but the ports realigned using the alignment device of the present invention.

Alignment ring 30 is preferably wedged at tapered surface 35 to inner wall 33 to keep it in position and for rotationally locking it. A keyway and key arrangement could be an alternative option or pin in a slot that has a bend and spring loading to hold the ring 30 rotationally locked to the housing 10 could also be used. Ring 30 has alternating peaks 32 and valleys 34 with the valleys 34 defined by a short axial slot to relieve stress at the transition 36 of a pair of sloping surfaces 38 and 40. Sloping surfaces 38 and 40 continuously alternate for 360 degrees such that on engagement of surfaces 42 and 44 with the sloping surfaces 38 and 40 the sliding sleeve 16 will either already be in alignment with the openings 12 in the housing 16 or as in the case of comparing FIGS. 1 and 2 be rotated into the desired alignment while the openings 12 remain closed. The sleeve 16 is moved by hydraulic fluid metering devices or j-slots or other techniques known in the art shown schematically with arrow 17. Thus if there are four openings 12 at 90 degree spacing then there will be four valleys 34 with preferably 90 degree spacing to insure as much alignment as possible with openings 18 and 20 on one hand and openings 12 on the other as illustrated in FIG. 2 with the openings 12 still closed because openings 18 and 20 are still on the opposite side of the seals 22 from openings 12 which effectively keeps openings 18 and 20 closed.

It is preferred that the dimensions of the meshing patterns at the lower end of the sleeve 16 and on the top of the alignment ring 30 have identical dimensions. Some variation in the peak angles 46 and 48 can be tolerated so that the angles are not the same with angles 46 preferably being smaller, but other variations are contemplated as long as enough rotation is induced to get the desired axial alignment between openings 18 and 20 on one hand and openings 12 on the other hand. Other meshing shapes are contemplated to get the desired rotation for opening alignment for full capacity operation of the choke valve. Applications to other tools are contemplated such as isolation sliding sleeve valves or other devices that operate on the principle of port alignment and axial misalignment with a peripheral seal in between.

Those skilled in the art will appreciate that the alignment method described above does not reduce the drift dimension of sleeve 16 and requires no removal of material from housing 10 for grooves to accept lugs or wall reductions into which a lug is inserted to potentially reduce the pressure rating of the housing. This can be a significant factor in deep applications or those with high operating differential pressures.

The above description is illustrative of the preferred embodiment and many modifications may be made by those skilled in the art without departing from the invention whose scope is to be determined from the literal and equivalent scope of the claims below:

We claim:

1. An alignment apparatus for ports of a movable member in a surrounding housing and ports in the housing of a subterranean tool, comprising:

a housing having a passage therethrough having at least one housing port and a sleeve in said passage having at least one sleeve port, wherein flow through said at least one housing port is closed with said at least one sleeve port on an opposite side of a seal than said at least one housing port and flow through said at least one housing port is enabled as said sleeve is actuated to move said at least one sleeve port toward the same side of said seal as said at least one housing port;

said at least one sleeve port axially movable relative to said at least one housing port while not rotationally restrained during said axial movement of said sleeve; and a rotational alignment feature on said sleeve and said housing to selectively rotate said sleeve about a longitudinal axis thereof to rotationally align said housing and sleeve ports, said rotational alignment occurring upon movement of said sleeve to position said at least one sleeve port on said opposite side of said seal from said at least one housing port and thereafter to position said alignment feature on an end of said sleeve against said alignment feature fixedly supported in said passage of said housing and substantially in alignment with said sleeve so that any misalignment of said alignment features creates relative rotation of said sleeve with respect to said housing when said alignment features are brought together whereupon separation of said alignment features with said axial movement of said sleeve allows said at least one housing port and said at least one sleeve port to fully overlap circumferentially as the amount of axial overlap of said at least one housing port and said at least one sleeve port is adjusted with said axial movement.

2. The apparatus of claim 1, wherein:

said alignment feature is mounted in part to an inner wall of said housing.

3. The apparatus of claim 2, wherein:

said inner wall of said housing defines said passage therein.

4. The apparatus of claim 2, wherein:

said alignment feature comprises a ring shaped element attached to said inner wall of said housing for rotational fixation thereof.

5. The apparatus of claim 4, wherein:

said ring shaped element is secured by a wedging fit to said housing.

6. The apparatus of claim 4, wherein:

said ring shaped element is axially fixed.

7. The apparatus of claim 1, wherein:

said alignment system comprises a repeating pattern profile on said end of said sleeve and a meshing profile with said repeating pattern profile on an alignment ring supported in said passage and secured to said housing.

8. The apparatus of claim 7, wherein:

said profiles extend for 360 degrees on said sleeve and on said alignment ring.

9. The apparatus of claim 6, wherein:

said profiles on said sleeve and on said alignment ring comprise adjacent sloping surfaces that meet at an angle that defines a peak between valleys.

10. The apparatus of claim 9, wherein:

said valleys on said alignment ring are fixedly positioned such that meshing of said profile on said sleeve will either result in no sleeve rotation if said at least one sleeve port in said sleeve is aligned with said at least one housing port or rotation of said at least one sleeve port into alignment with said at least one housing port.

11. The apparatus of claim 10, wherein:

said at least one port on said sleeve and said at least one port on said housing comprise multiple ports having the same circumferential spacing on said sleeve and said housing.

12. The apparatus of claim 11, wherein:

said peaks or valleys on said alignment ring are circumferentially displaced the same amount as said ports on said housing such that end contact of said sleeve to said peaks and valleys of said alignment ring puts said sleeve ports in axial alignment with said housing ports.

13. The apparatus of claim 9, wherein:

said angle defining said peaks on said sleeve is the same as said angle defining said peaks on said alignment ring.

14. The apparatus of claim 9, wherein:

said valleys on said sleeve and on said alignment ring further comprise an axially extending groove to reduce stress in said valleys.

15. The apparatus of claim 9, wherein:

said angle defining said peaks on said sleeve is different than said angle defining said peaks on said alignment ring.

16. The apparatus of claim 7, wherein:

said profiles on said sleeve and on said alignment ring are identical.

17. The apparatus of claim 7, wherein:

said profile on said sleeve does not reduce a drift dimension of a sleeve passage running through said sleeve.

18. The apparatus of claim 1, wherein:

said sleeve is not rotationally locked to said housing.

19. An alignment apparatus for ports of a movable member in a surrounding housing and ports in the housing of a subterranean tool, comprising:

a housing having a passage therethrough having at least one housing port and a sleeve in said passage having at least one sleeve port, wherein flow through said at least one housing port is closed with said at least one sleeve port on an opposite side of a seal than said at least one housing port and flow through said at least one housing port is enabled as said sleeve is hydraulically actuated with a hydraulic fluid metering device to move said at least one sleeve port toward the same side of said seal as said at least one housing port;

an alignment feature on said sleeve and said housing to selectively rotate said sleeve about a longitudinal axis thereof to rotationally align said at least one housing and sleeve ports upon selective end engagement of said sleeve to said housing;

said alignment feature is mounted in part to an inner wall of said housing;

said alignment feature comprises a ring shaped element attached to said inner wall of said housing for rotational fixation thereof;

said ring shaped element has a tapered outer surface that is pushed against a surrounding tapered surface that defines a part of said passage in said housing to mount said ring shaped element fixedly against rotation force from said turning sleeve for aligning said opening of said sleeve and said housing.

* * * * *